US006286166B1

(12) United States Patent
Henley et al.

(10) Patent No.: US 6,286,166 B1
(45) Date of Patent: Sep. 11, 2001

(54) MODULAR FOAM MATTRESS

(75) Inventors: Alan W. Henley, Summerville; James R. Stolpmann, Charlestown, both of SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/334,984

(22) Filed: Jun. 17, 1999

Related U.S. Application Data

(60) Provisional application No. 60/089,819, filed on Jun. 19, 1998.

(51) Int. Cl.[7] ..... A47G 27/16

(52) U.S. Cl. ..... 5/722; 5/727; 5/730; 5/739; 5/740

(58) Field of Search ..... 5/698, 722, 723, 5/727, 738, 739, 740, 483, 906, 926, 932, 484, 497, 499, 699, 496

(56) References Cited

U.S. PATENT DOCUMENTS

| | | | | |
|---|---|---|---|---|
| 2,029,370 | | 2/1936 | Heldenbrand . | |
| 2,742,652 | | 4/1956 | Mautz . | |
| 2,757,389 | * | 8/1956 | King | 5/496 |
| 3,000,020 | | 9/1961 | Lombard et al. . | |
| 3,047,888 | | 8/1962 | Shecter et al. . | |
| 3,083,379 | * | 4/1963 | Marinsky | 5/496 |
| 3,419,920 | * | 1/1969 | Maddux, Jr. et al. | 5/722 X |
| 3,939,508 | | 2/1976 | Hall et al. . | |
| 4,580,301 | | 4/1986 | Ludman et al. . | |
| 4,628,557 | | 12/1986 | Murphy . | |
| 4,672,702 | * | 6/1987 | Isham | 5/499 X |
| 4,706,313 | * | 11/1987 | Murphy | 5/722 |
| 4,777,681 | | 10/1988 | Lück et al. . | |
| 4,803,744 | | 2/1989 | Peck et al. . | |
| 4,947,500 | | 8/1990 | Seiler . | |
| 4,982,466 | | 1/1991 | Higgins et al. . | |
| 4,998,310 | | 3/1991 | Olson . | |
| 5,070,560 | | 12/1991 | Wilkinson . | |
| 5,081,728 | | 1/1992 | Skinner . | |
| 5,088,136 | | 2/1992 | Stryker et al. . | |
| 5,105,488 | | 4/1992 | Hutchinson et al. . | |
| 5,127,119 | * | 7/1992 | Rogers | 5/738 X |
| 5,136,741 | * | 8/1992 | Balonick et al. | 5/723 X |
| 5,179,742 | * | 1/1993 | Oberle | 5/740 X |
| 5,201,780 | | 4/1993 | Dinsmoor, III et al. . | |
| 5,231,717 | | 8/1993 | Scott et al. . | |
| 5,255,404 | | 10/1993 | Dinsmoor, III et al. . | |
| 5,259,079 | | 11/1993 | Visser et al. . | |
| 5,272,779 | * | 12/1993 | Payton | 5/698 |
| 5,325,551 | | 7/1994 | Tappel et al. . | |
| 5,331,698 | | 7/1994 | Newkirk et al. . | |
| 5,513,402 | | 5/1996 | Schwartz . | |
| 5,680,662 | | 10/1997 | Purdy et al. . | |
| 5,802,646 | | 9/1998 | Stolpmann et al. . | |
| 5,815,865 | | 10/1998 | Washburn et al. . | |

FOREIGN PATENT DOCUMENTS

| | | |
|---|---|---|
| WO 99/49761 | 10/1999 | (WO) . |

* cited by examiner

*Primary Examiner*—Michael F. Trettel
(74) *Attorney, Agent, or Firm*—Bose McKinney & Evans LLP

(57) ABSTRACT

A mattress includes a cover defining an interior region and a plurality of foam modules located in the interior region of the cover. Each of the plurality of foam modules is separately removable from the interior region and has a central foam portion and first and second side foam portions coupled to and extending along opposite sides of the central foam portion to provide a module width dimension substantially equal to the width dimension of the mattress.

43 Claims, 9 Drawing Sheets

MODULAR FOAM MATTRESS

This application claims the benefit of U.S. provisional application Serial No. 60/089,819 filed Jun. 19, 1998.

BACKGROUND AND SUMMARY OF THE INVENTION

The present invention relates to a mattress for supporting a body. More particularly, the present invention relates to a modular foam mattress apparatus which provides a pressure reduction surface for supporting a body.

The present invention includes a mattress having a plurality of foam components located between a bottom cover and a top cover. The mattress includes a plurality of modular foam sections which allow easy replacement of modular components, as necessary. The top and bottom cover are coupled together by a wrap-around zipper which allows a caregiver to choose an appropriate type of cover for particular clinical and financial needs.

Additional features and advantages of the invention will become apparent to those skilled in the art upon consideration of the following detailed description of the illustrated embodiments exemplifying the best mode of carrying out the invention as presently perceived.

DETAILED DESCRIPTION OF THE DRAWINGS

Figure 1:
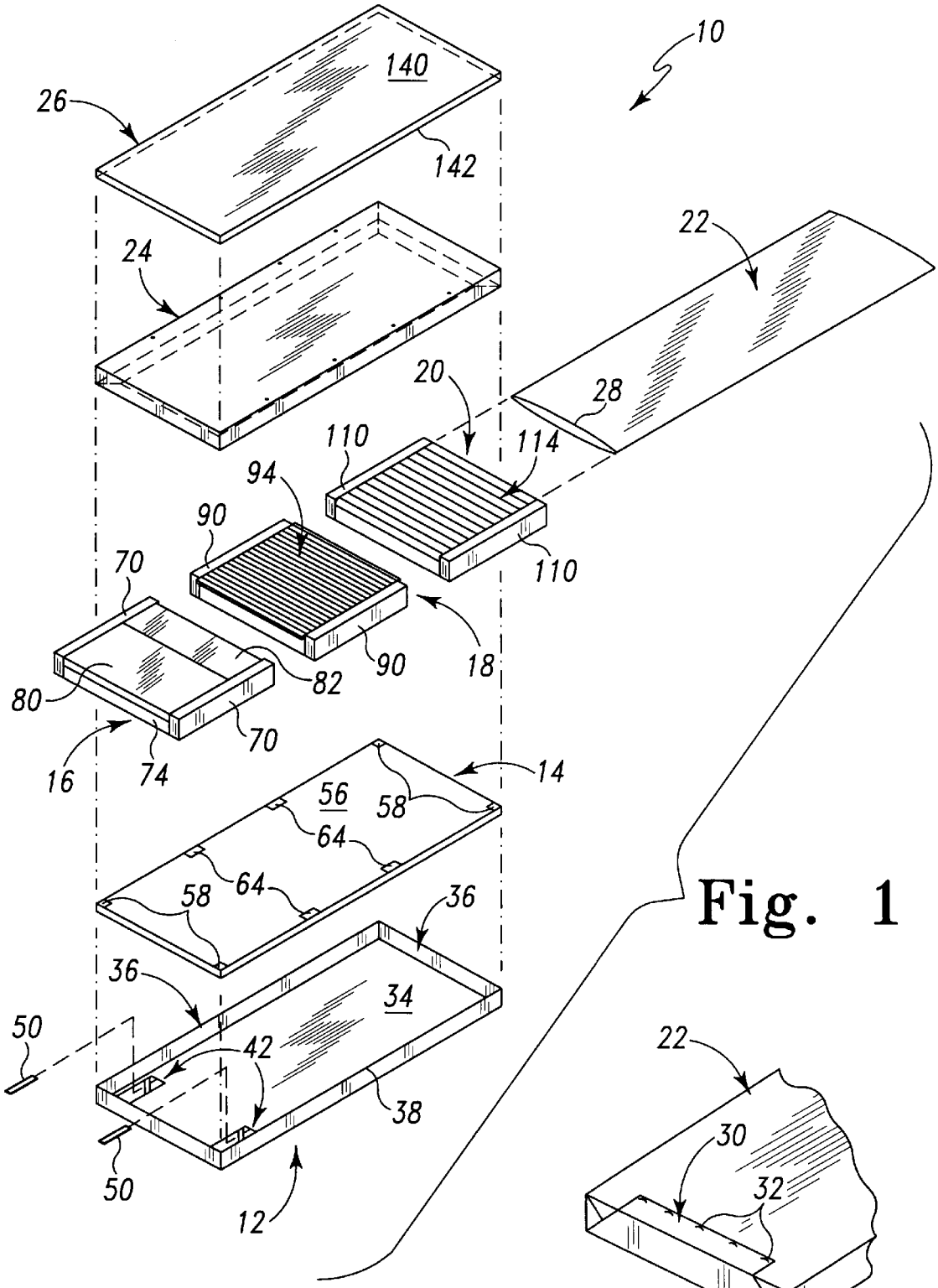
FIG. 1 is an exploded perspective view of one embodiment of the modular foam mattress of the present invention.

Referring now to the drawings, FIG. 1 illustrates a modular foam mattress 10 including a bottom cover 12, a foam base 14, a foot foam section 16, a back or seat foam section 18, and a head foam section 20. A fire sock or barrier 22 is configured to surround the foot section 16, seat section 18, head section 20 and base 14. A shear cover 24 is configured to be situated over the fire barrier 22, the foot section 16, seat section 18, head section 20 and base 14. A top cover 26 is configured to be coupled to the bottom cover 12 to form the mattress 10.

Figure 2:
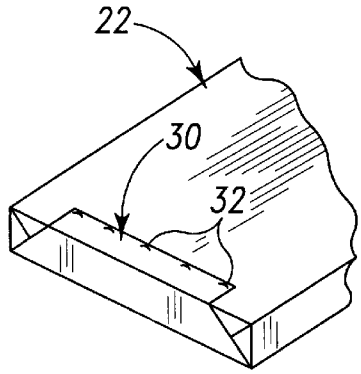
FIG. 2 is a perspective view illustrating securement of a fire barrier around the foam components of the mattress.
Figure 6:
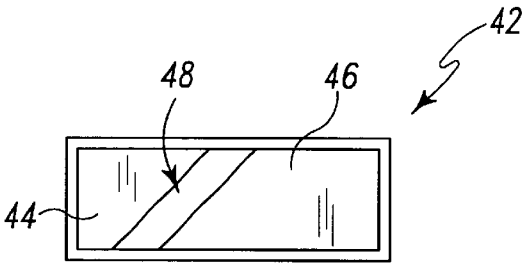
FIG. 6 is an enlarged view illustrating a magnet pocket formed in the bottom cover.

FIG. 2 is a bottom view illustrating installation of the fire barrier 22 over the base 14, foot section 16, seat section 18, and head section 20. Fire barrier 22 includes an open end 28 configured to permit the fire barrier to slide over the other components. FIG. 2 illustrates the foot end 30 of the fire barrier 22 which is folded under the foot section 16 and closed as shown. The fire barrier 22 illustratively is closed with spaced apart safety pins 32.

Figure 4:
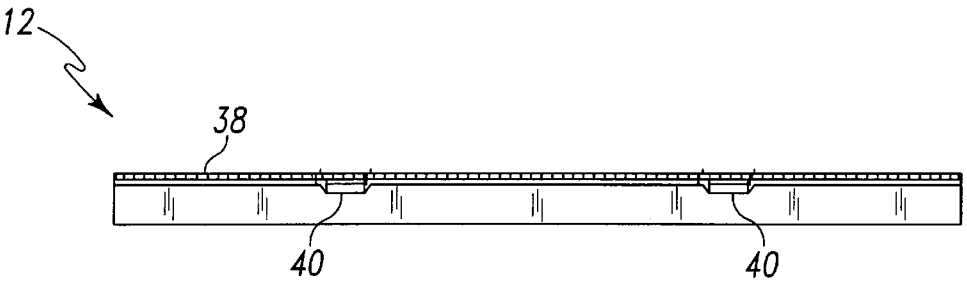
FIG. 4 is a side elevational view of the bottom cover of FIG. 3.

Further details of the bottom cover 12 are illustrated in FIGS. 3–6. Bottom cover 12 includes a bottom surface 34 and upstanding side walls 36. A zipper 38 is coupled around the side wall 36 as illustrated in FIG. 4. Illustratively, the bottom cover 12 is made from a vinyl material. Handles 40 are coupled to the side wall 36 of bottom cover 12 to facilitate placement and positioning of the mattress 10.

Figure 5:
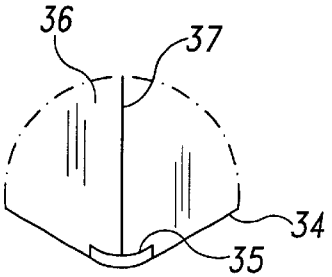
FIG. 5 is an enlarged view illustrating formation of a corner of the lower cover.
Figure 3:
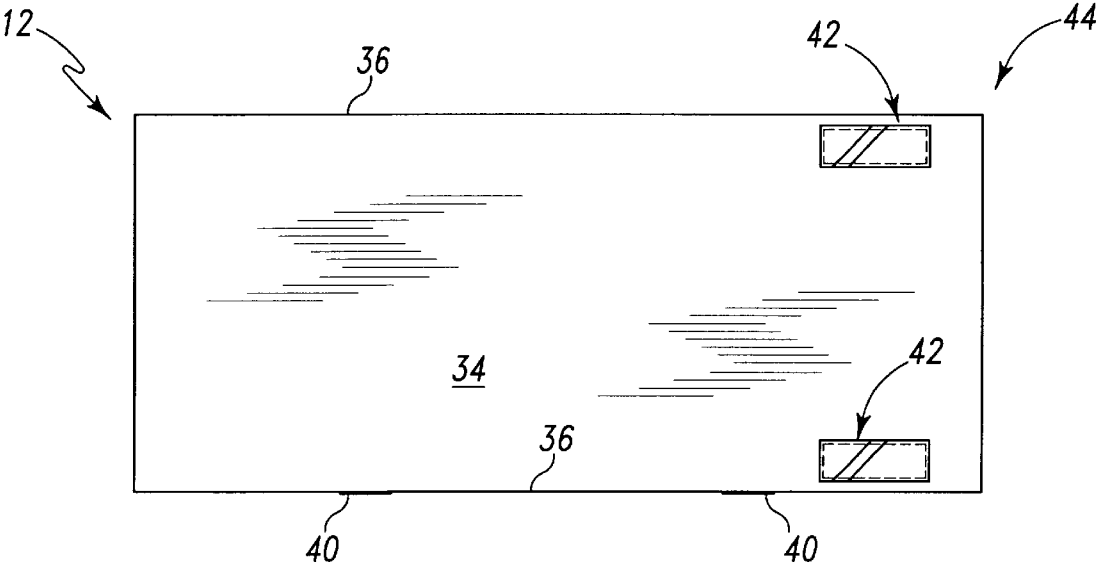
FIG. 3 is a top plan view illustrating a bottom cover.

FIG. 5 illustrates details of a corner of bottom cover. Cover 12 is illustratively sewn along lines 35 and 37 to form the corner.

Bottom cover 12 is also formed to include a pair of magnet pockets 42 formed near foot end 44. The magnet pocket 42 is illustrated in further detail in FIG. 6. The magnet pocket 42 includes first and second spaced-apart sections 44 and 46 which are R.F. welded to the bottom surface 34 of bottom cover 12. An opening 48 is formed for receiving a magnet 50.

Figure 7:
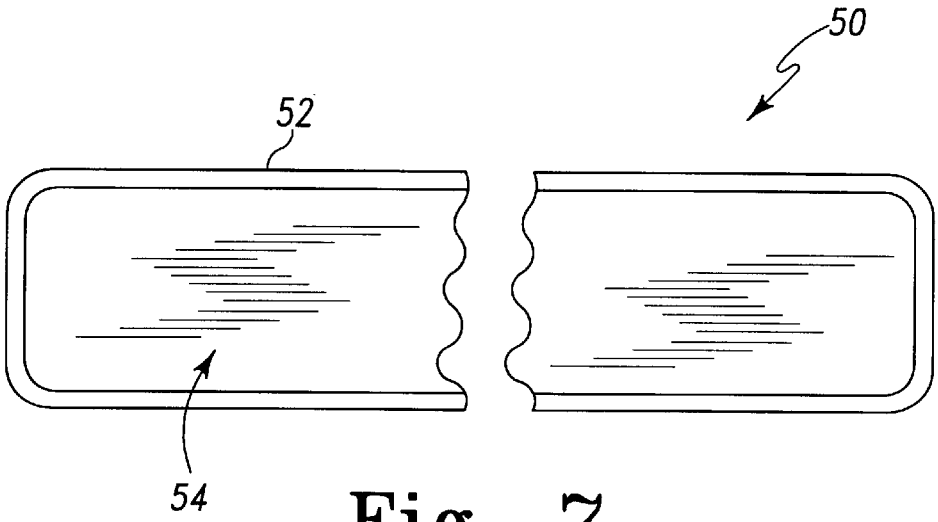
FIG. 7 is a top plan view of a magnet configured to be inserted into the magnet pocket of the bottom cover.
Figure 8:
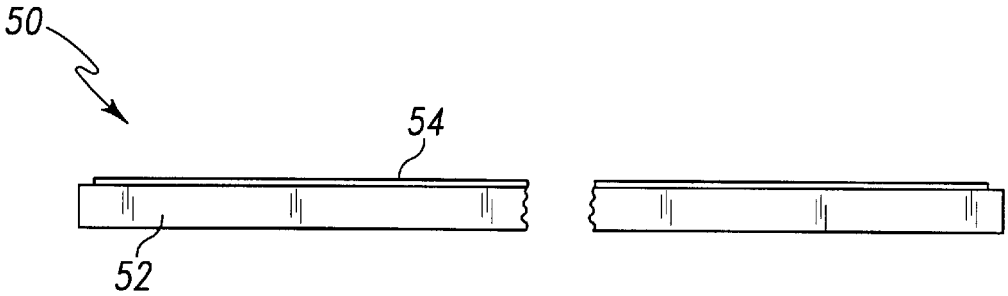
FIG. 8 is a side elevational view of the magnet of FIG. 7.
Figure 9:
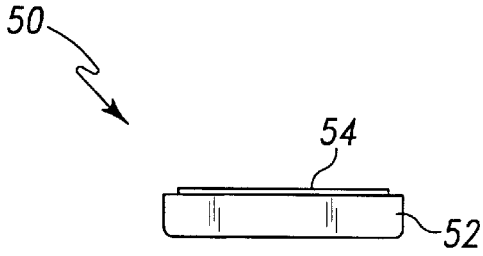
FIG. 9 is an end view of the magnet of FIGS. 7 and 8.

The magnets 50 are best illustrated in FIGS. 7–9. Magnets 50 include a magnet body 52 and a back-up plate 54. The back-up plate 54 is illustratively zinc or galvanized plated. The back-up plate is bonded to the magnet by a suitable adhesive. A magnet 50 is configured to be inserted into each pocket 42 as illustrated in FIG. 1. Illustratively, the magnets 50 at foot end 44 aid in sheet retention and reduce mattress slippage.

Figure 10:
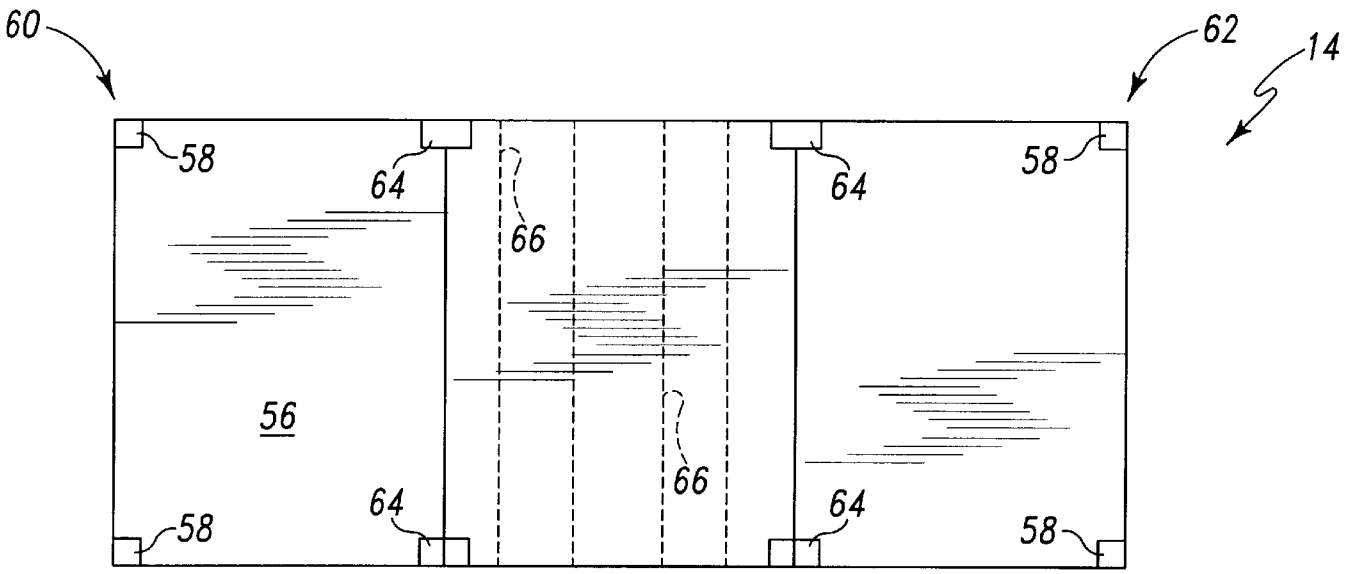
FIG. 10 is a top plan view of a foam base configured to be situated over bottom surface of the bottom cover.
Figure 11:
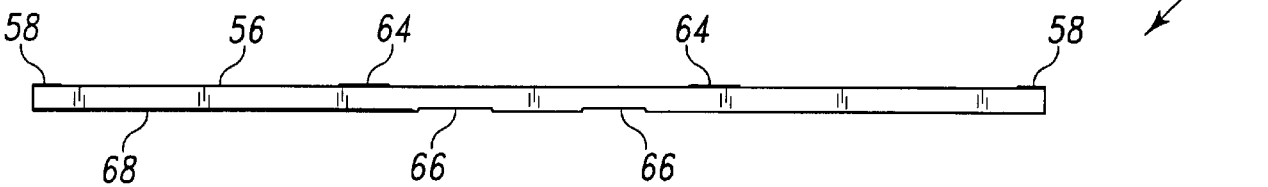
FIG. 11 is a side elevational view of the foam base of FIG. 10.

The foam base 14 is best illustrated in FIGS. 10 and 11. Illustratively, foam base 14 is made from a polyurethane foam having an ILD of about 35 to about 40, with a support factor of about 2.0 MIN. The density of base 14 is about 1.8 to about 1.9 PCF. Base 14 includes a top surface having Velcro material fastening sections 58 adjacent head end 60 and foot end 62. Larger Velcro fastener sections 64 are coupled to top surface 56 of base 14 as shown in FIG. 10. It is understood that other fastening means may be used instead of Velcro fastener sections 58 and 64. Base 14 further includes notched sections 66 formed in a bottom surface 68 to permit insertion of bed exit detection strips across the width of the mattress 10. Velcro fastener sections 58 and 64 are used to couple the foot section 16, seat section 18, and head section 20 to the base 14 as discussed below.

Figure 12:
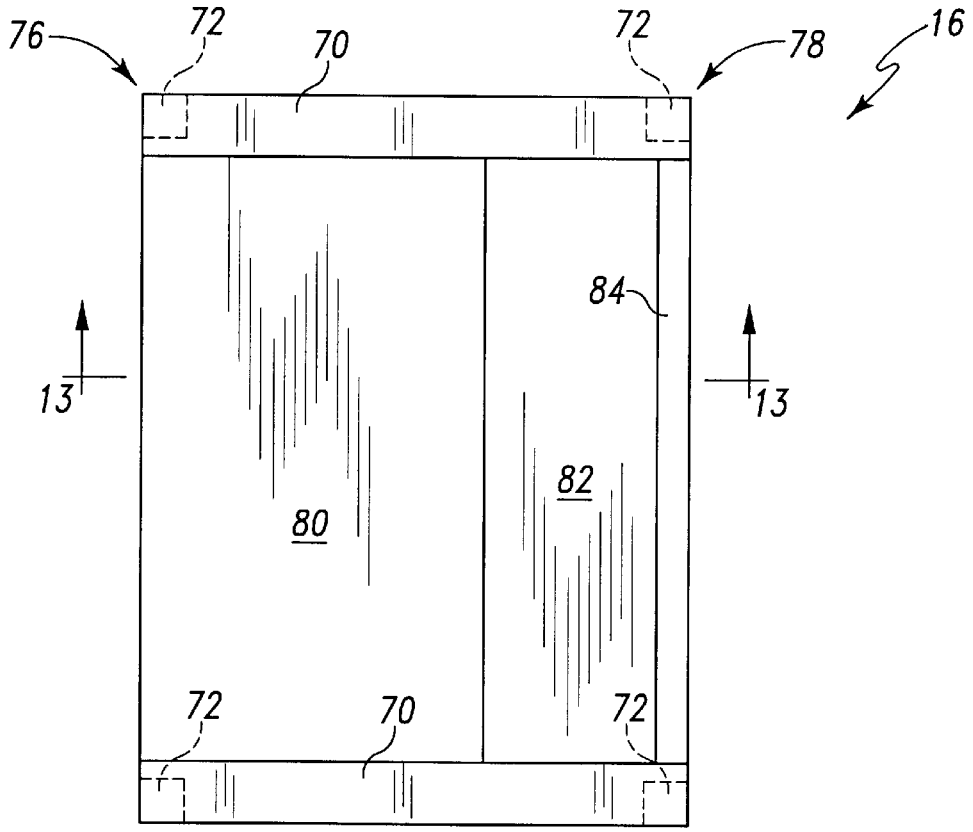
FIG. 12 is a top plan view of a foot section foam module.
Figure 13:
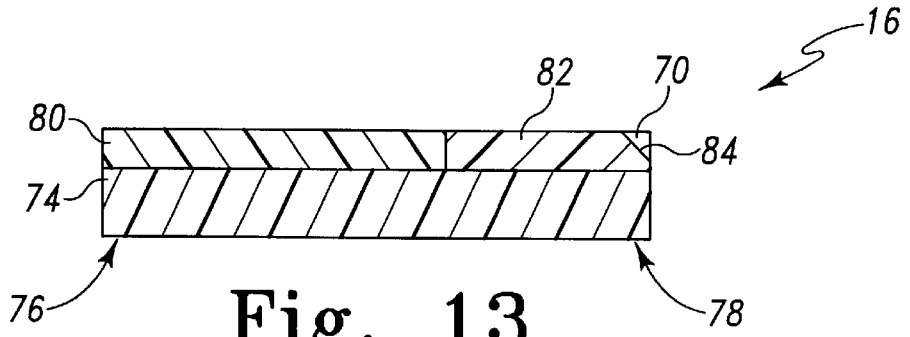
FIG. 13 is a sectional view taken through the foot section foam module of FIG. 12.
Figure 14:
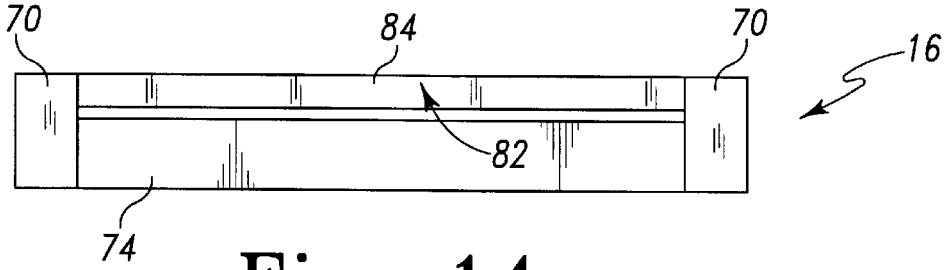
FIG. 14 is an end view of the foot section module of FIGS. 12 and 13.

The modular foot foam section 16 is illustrated in FIGS. 12–14. Foot section 16 includes outer perimeter foam sections 70 extending along opposite sides of the foot section 16. Velcro fastener material 72 is coupled to the four corners of foot section 16 on perimeter foam sections 70 as illustrated in FIG. 12. Velcro fastener material 72 is configured to be coupled to Velcro fastener material 58 adjacent foot end 60 of base 14 and to a portion of Velcro material 64 adjacent foot end 60.

Side perimeter foam sections 70 illustratively are made from a polyurethane foam material having an ILD of about 35 to about 40 and a support factor of about 2.0 MIN. Illustratively, perimeter foam sections 70 have a density of about 1.8 to about 1.9 PCF.

Foot section 16 includes a bottom base 74 extending from foot end 76 to head end 78 of foot section 16. Base 74 is illustratively made from a high resiliency polyurethane foam material having an ILD of about 11 to about 15 and a support factor of about 2.4 MIN. The density of base 74 is illustratively about 1.9 MIN. PCF.

A heel section 80 is located on top of base 74 adjacent foot end 76 of foot section 16. Illustratively, heel section 80 is a high resiliency polyurethane foam material having an ILD of about 7 to about 10 and a support factor of about 2.4 MIN. The density of heel section 80 is about 1.5 to about 1.6 PCF.

A calf section 82 is located on top of base 74 adjacent heel section 80 at the head end 78 of foot section 16. Calf section 82 includes an angled edge surface 84 as best shown in FIG. 13. Illustratively, calf section 82 is made a high resiliency polyurethane foam material having an ILD of about 17 to about 21 and a support factor of about 2.4 MIN. Calf section 82 illustratively has a density of about 2.25 to about 2.5 PCF. All the foam components of foot section 16 are bonded together with suitable adhesive.

Figure 15:
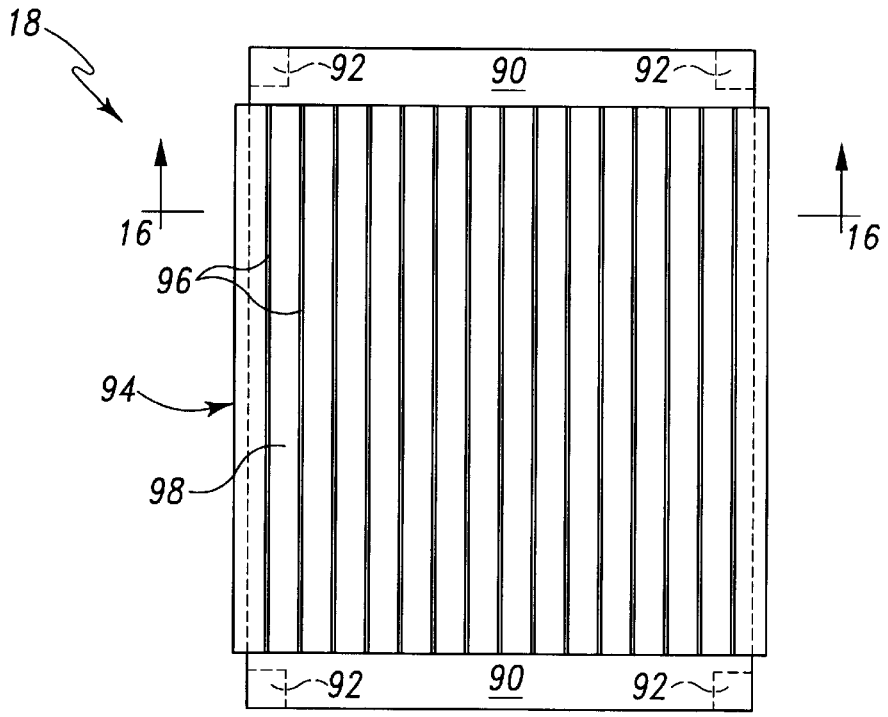
FIG. 15 is a top plan view of a back or seat section foam section module.
Figure 16:
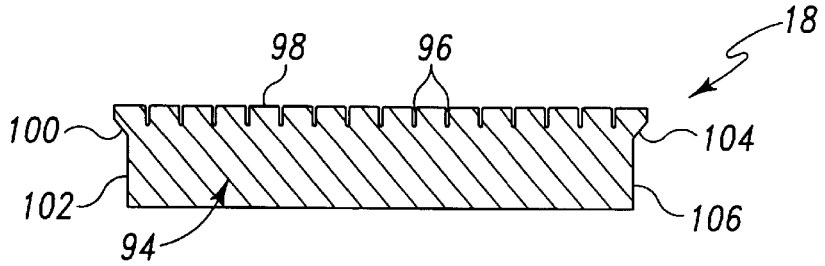
FIG. 16 is a sectional view taken through the seat section foam module of FIG. 15.
Figure 17:
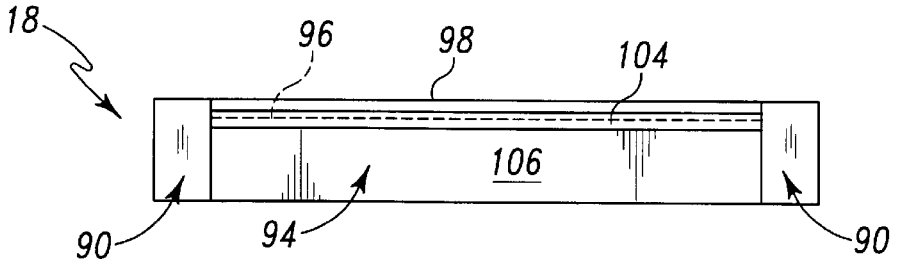
FIG. 17 is an end view of the seat section foam module of FIGS. 15 and 16.

The seat foam section 18 is best illustrated in FIGS. 15–17. Seat section 18 includes perimeter foam sections 90 having Velcro fastener material 92 coupled to a bottom surface at the locations indicated in FIG. 15. Velcro fastener material 92 is configured to be coupled to inner portions of Velcro fastener material 64 at the center of base 14 illustrated in FIG. 10. Perimeter foam sections 90 are made of the same type of material as perimeter foam sections 70 discussed above.

Seat section 18 further includes a central foam portion 94 having cut or notched portions 96 extending transversely across its top surface 98 as best illustrated in FIG. 16. Seat foam section 94 includes a first angled section 100 extending outwardly away from foot end wall 102 and a second angled portion 104 extending outwardly away from head end wall 106. Angled surface 100 is configured to abut angled edge surface 84 of foot section 16.

Center foam section 94 is illustratively formed from a high resiliency polyurethane material having an ILD of about 23 to about 27 with a support factor of about 2.4 MIN. The density of scat foam section 94 is about 2.25 to about 2.5 PCF. All the foam components of the seat section 18 are illustratively securely bonded together with a suitable adhesive.

Figure 18:
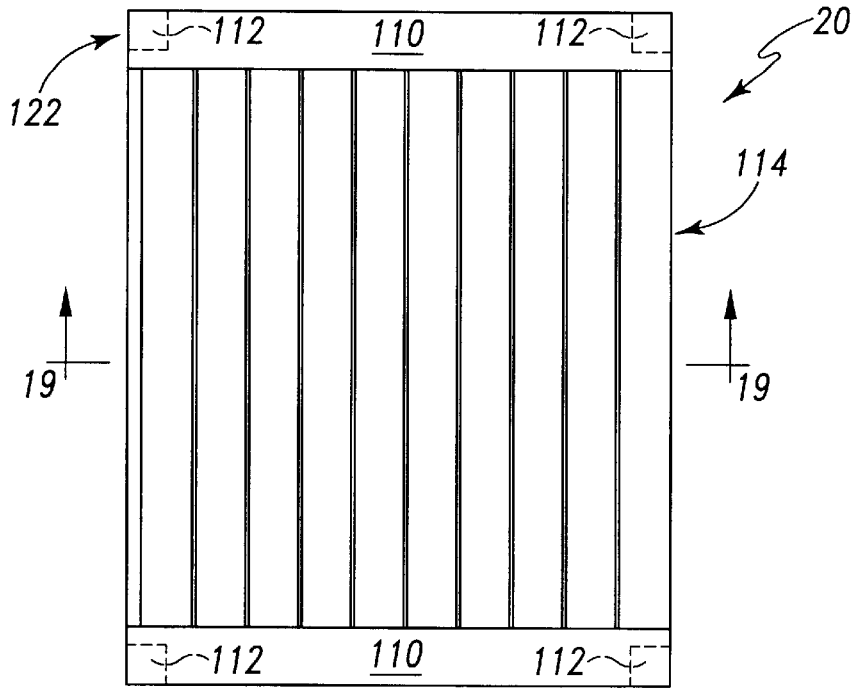
FIG. 18 is a top plan view of a head section foam module.
Figure 19:
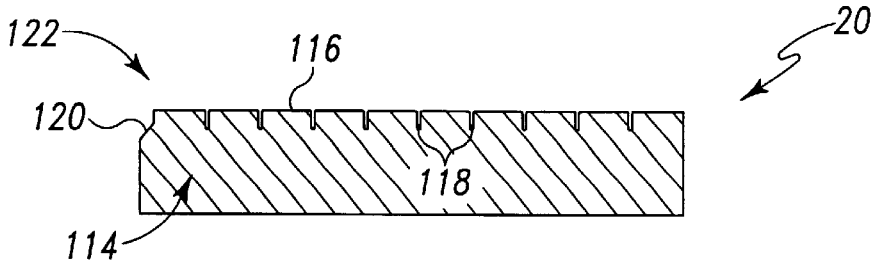
FIG. 19 is a sectional view taken through the head section module.
Figure 20:
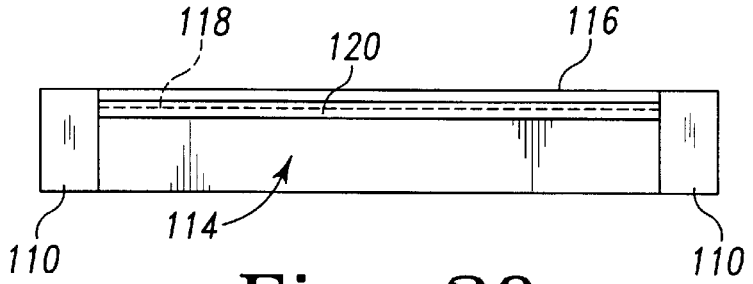
FIG. 20 is an end view of the head section module of FIGS. 18 and 19.

Details of head foam section 20 are illustrated in FIGS. 18–20. Head foam section 20 includes perimeter foam sections 110 extending along opposite sides of head section 20. Perimeter foam sections 110 are illustratively made from the same material as perimeter foam sections 70 and 90 discussed above. Foam sections 110 include Velcro fastener material 112 coupled to corners of a bottom surface as illustrated in FIG. 18. Velcro fastener material 112 is configured to be coupled to Velcro fastener material 58 adjacent head end 62 of base 14 and a portion of Velcro fastener material 64 nearest head end 62 of base 14.

Head section 20 includes a central foam section 114 having a top surface 116 formed to include a plurality of transversely extending cuts or notches 118 as best shown in FIG. 19. Illustratively, central foam portion 114 is made from a high resiliency polyurethane foam material having an ILD of about 17 to about 21 and a support factor of about 2.4 MIN. Density of central foam section 114 is about 2.25 to about 2.5 PCF. Central foam section 114 is formed to include an angled edge surface 120 adjacent foot end 122 of head section 20 which is configured to engage the angled surface 104 adjacent head end wall 106 of scat section 18.

The deep lateral cuts 96 and 118 in seat section 18 and head section 20, respectively, minimize pressure points on a body situated on the mattress 10. Illustrative pressure maps for the mattress 10 are illustrated in attached Exhibit A.

The modular components including foot section 16, seat section 18, and head section 20 are replaceable for appropriate body contouring. In addition, the modular foam sections may be replaced with multi-layered foam as discussed in attached Exhibit A describing the Comfortline® mattress "Basic" model.

It is understood that other types of fasteners may be used to secure the foot foam section 16, the seat foam section 18, and the head foam section 20 to the base 14. For instance, the Velcro fastening material on these sections may be replaced by snaps, ties, locator posts and apertures, or other suitable fasteners.

Figure 21:
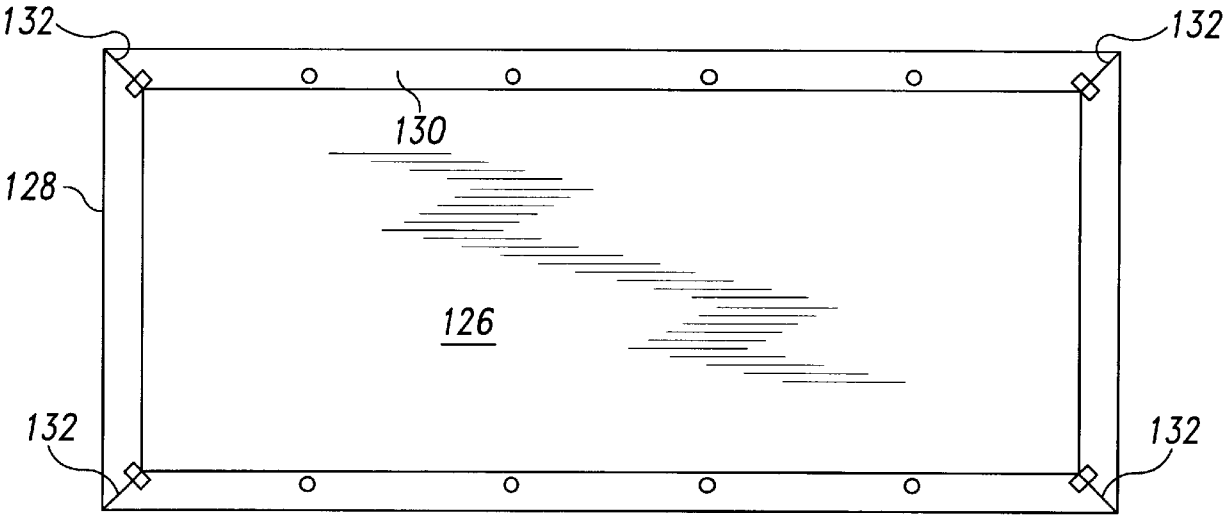
FIG. 21 is a bottom plan view of a shear cover configured to be situated over the foot section module, the seat section module, the head section module and the foam base.
Figure 22:
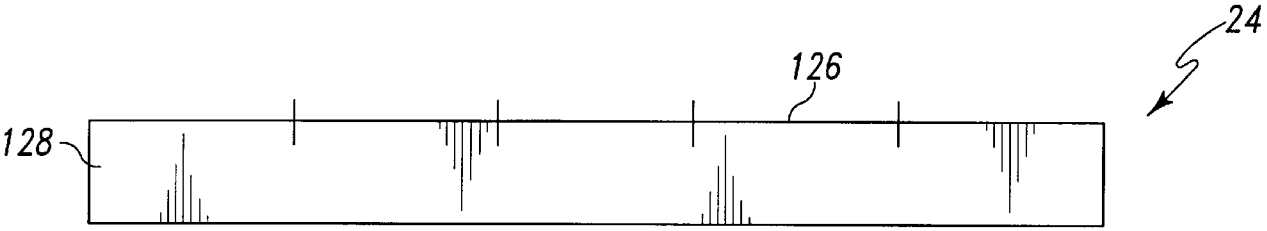
FIG. 22 is a side elevational view of the shear cover of FIG. 21.
Figure 24:
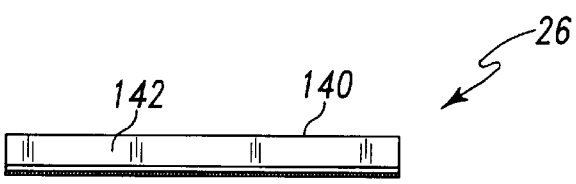
FIG. 24 is an end view of the top cover.

FIGS. 21 and 22 illustrate the shear cover configured to fit over the foam mattress components. The shear cover 24 includes a top surface 126, a side wall 128, and a bottom inwardly extending flap 130. RF welded seams are used to form the four corners of the shear cover 24. The shear cover 24 is configured to be located between the foam components and the top cover 26 to permit the top cover to slide easily over the foam components to reduce shear forces between the patient's body and the mattress and reduce the likelihood of sacral breakdown.

Shear cover 24 is formed from a material having a low coefficient of friction so that the mattress cover can slide relative to the foam core. As the mattress is articulated or as the patient moves, the shear cover 24 minimizes shear forces acting between the mattress cover the user's body. The shear cover may be made from a woven nylon or "parachute" material. Illustratively, the shear cover 24 is made from a polyurethane material such as Deerfield urethane PT6110S thickness 0.002. The polyurethane material provides an inexpensive shear material which reduces shear forces applied to the user's body situated on the mattress 10.

Figure 27:
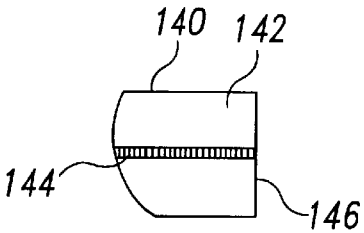
FIG. 27 is an enlarged view illustrating further details of the zipper and R. F. weld seal of the top cover.
Figure 23:
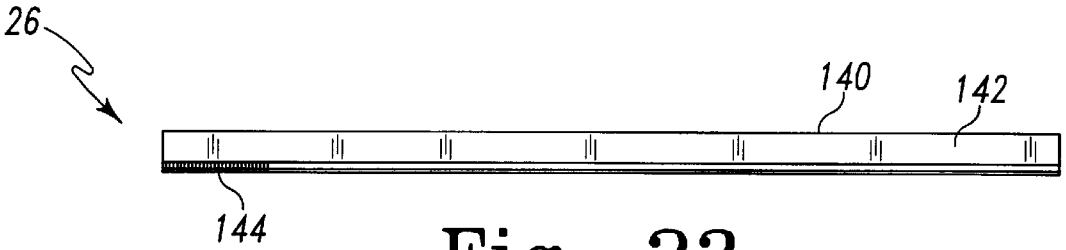
FIG. 23 is a side elevational view of a top cover.
Figure 26:
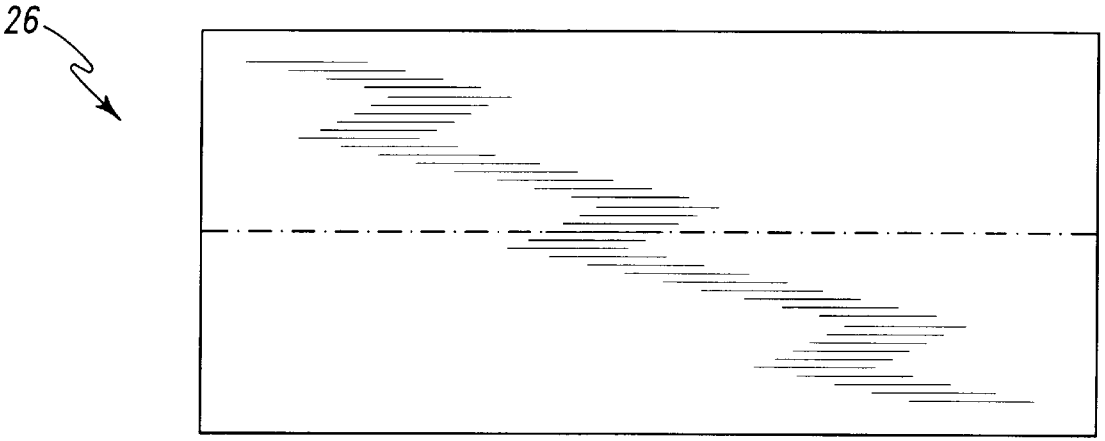
FIG. 26 is a bottom plan view of the top cover.

Details of the top cover 26 are best illustrated in FIGS. 23–27. Cover 26 includes a top surface 140 and a side wall 142, A zipper 144 is coupled to the side wall 142 to mate with zipper 38 of bottom cover 12. Illustratively, zipper 144 wraps entirely around the top cover 26 to facilitate removal and replacement of the modular components. Illustratively, the zipper 144 is RF sealed to the side wall 142 around the perimeter. FIG. 27 illustrates further details of the side wall 142 and zipper 144. A flap of material 146 extends downwardly past zipper 144 to reduce the likelihood that fluids will enter through zipper 144.

Figure 25:
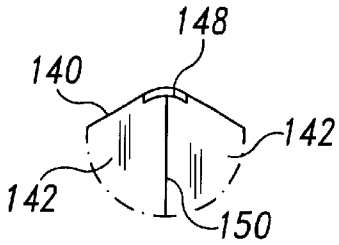
FIG. 25 is an enlarged view illustrating R.F. welded seams which form corners of the top cover.

FIG. 25 illustrates formation of the four corners of top cover 25. The corners are RF welded near top surface 140 as illustrated by seam line 148 and downwardly from top seam 148 as illustrated by seam line 150 to form the corner and to reduce the likelihood that fluids will leak into an interior region of the mattress 10.

Illustratively, top cover 26 is formed from a stretchable polyurethane material which is resistant to fluids and chemical stains. The cover may also be formed from a soft nylon material having a smooth, low friction surface, if desired.

Although the invention has been described in detail with reference to certain illustrated embodiments, variations and modifications exist within the scope and spirit of the present invention as described and defined in the following claims.

What is claimed is:

1. A mattress comprising:

a cover having an interior region and a bottom surface;

a foam base having a head end and a foot end;

a foot foam section located adjacent to the foot end of the base;

a head foam section located adjacent to the head end of the base;

a seat foam section located between the foot and head foam sections;

a plurality of fasteners configured to couple the foot, head and seat foam sections to the base, at least one pocket formed on the bottom surface of the cover; and a magnet located in each of the at least one pockets.

2. The apparatus of claim 1, wherein a plurality of fasteners include a plurality hook and loop fastener portions coupled to the base and the foot, head and seat foam sections.

3. The apparatus of claim 1, further comprising a shear cover configured to be located over the foot, head and seat foam sections, the shear cover having a low coefficient of friction so that the cover is permitted slide relative to the foot, head and seat foam sections.

4. The apparatus of claim 3, further comprising a fire barrier located over the foot, head and seat foam sections, the shear cover being located over the fire barrier.

5. A mattress comprising:

a cover having an interior region, a head end, and a foot end;

a foot foam section located adjacent to the foot end of the cover, the foot foam section having a head end formed to include a first angled edge surface, the foot foam section including side foam portions extending along opposite sides of the foot foam section and a central foam portion located between the side foam portions, the side foam portions having a density greater than the central foam portion;

a head foam section located adjacent to the head end of the cover, the head foam section having a foot end formed to include a second angled edge surface; and a seat foam section located between the foot and head foam sections, the seat foam section having a foot end formed to include a third angled edge surface and a head end formed to include a fourth angled edge surface, the first angled edge surface being configured to engage the third angled edge surface and the second angled edge surface being configured to engage the fourth angled edge surface.

6. The apparatus of claim 5, wherein the central foam portion includes a foot base portion, a heel section located on the foot base portion and a calf section located above the foot base portion adjacent to the heel section, the calf section having a density greater than the heel section.

7. The apparatus of claim 6, wherein the heel section has an ILD of about 7 to about 10 and the calf section has an ILD of about 17 to about 21.

8. The apparatus of claim 6, wherein the calf section includes the first angled edge surface configured to abut the third angled surface formed on the seat foam section.

9. A mattress comprising:

a cover having an interior region, a head end, and a foot end;

a foot foam section located adjacent to the foot end of the cover, the foot foam section having a head end formed to include a first angled edge surface;

a head foam section located adjacent to the head end of the cover, the head foam section having a foot end formed to include a second angled edge surface; and a seat foam section located between the foot and head foam sections, the seat foam section having a foot end formed to include a third angled edge surface and a head end formed to include a fourth angled edge surface, the first angled edge surface being configured to engage the third angled edge surface and the second angled edge surface being configured to engage the fourth angled edge surface, the seat foam section including a central foam portion having a top surface formed to include a plurality of transversely extending notches and first and second side foam portions located on opposite sides of the central foam portion.

10. The apparatus of claim 9, wherein the seat central foam portion has an ILD of about 23 to about 27 and the side foam portions have an ILD of about 35 to about 40.

11. The apparatus of claim 9, wherein the central foam portion of the seat foam section includes the third and fourth angled surfaces located at opposite ends, the third and fourth angled surfaces being configured to engage the complementary first angled surface formed on the foot foam section and the second angled surface formed on the head foam section, respectively.

12. A mattress comprising:

a cover having an interior region, a head end, and a foot end;

a foot foam section located adjacent to the foot end of the cover, the foot foam section having a head end formed to include a first angled edge surface;

a head foam section located adjacent to the head end of the cover, the head foam section having a foot end formed to include a second angled edge surface, the head foam section including a central foam portion having a top surface formed to include a plurality of transversely extending notches and first and second side foam portions located on opposite sides of the central foam portion; and a seat foam section located between the foot and head foam sections, the seat foam section having a foot end formed to include a third angled edge surface and a head end formed to include a fourth angled edge surface, the first angled edge surface being configured to engage the third angled edge surface and the second angled edge surface being configured to engage the fourth angled edge surface.

13. The apparatus of claim 12, wherein the head center foam portion has an ILD of about 17 to about 21 and the first and second side foam portions have an ILD of about 35 to about 40.

14. The apparatus of claim 12, wherein the head central foam portion has a foot end formed to include the second angled edge surface which is configured to engage the fourth angled edge surface formed on the head end of the seat foam section.

15. A mattress comprising:

a cover having an interior region, a head end, and a foot end, the cover including a top cover portion having four corners, each of the four corners including a vertical seam extending downwardly from a location adjacent a top surface of the top cover to a bottom edge of the top cover and a generally horizontal seam adjacent to the top surface of the top cover to form a substantially T-shaped seam;

a foot foam section located adjacent to the foot end of the cover, the foot foam section having a head end formed to include a first angled edge surface;

a head foam section located adjacent to the head end of the cover, the head foam section having a foot end formed to include a second angled edge surface; and a seat foam section located between the foot and head foam sections, the seat foam section having a foot end formed to include a third angled edge surface and a head end formed to include a fourth angled edge surface, the first angled edge surface being configured to engage the third angled edge surface and the second angled edge surface being configured to engage the fourth angled edge surface.

16. A mattress having a head end and a spaced apart foot end defining a length dimension and spaced apart first and second sides defining a width dimension, the mattress comprising:

a cover defining an interior region; and a plurality of foam modules located in the interior region of the cover, each of the plurality of foam modules being separately removable from the interior region and having a central foam portion and first and second side foam portions coupled to and extending along opposite sides of the central foam portion to provide a module width dimension substantially equal to the width dimension of the mattress, and each module having a module length dimension less than the length dimension of the mattress, the first and second side foam portions each having a firmness greater than a firmness of the central foam portion so that the first and second side foam portions of the plurality of modules cooperate to define first and second borders extending along the first and second sides of the mattress, respectively, between the head end and the foot end of the mattress.

17. The mattress of claim 16, further comprising a foam base located in the interior region of the cover below the plurality of foam modules.

18. The mattress of claim 16, further comprising a plurality of fasteners configured to couple the plurality of foam modules to the base.

19. The mattress of claim 16, further comprising a shear cover configured to be located over the plurality of foam modules, the shear cover having a low coefficient of friction so that the cover is permitted slide relative to the plurality of foam modules.

20. The mattress of claim 19, further comprising a fire barrier located over the plurality of foam modules, the shear cover being located over the fire barrier.

21. The mattress of claim 16, wherein the cover includes a bottom surface formed to include at least one pocket, and further comprising a magnet located in each of the at least one pockets.

22. The mattress of claim 16, wherein the first and second side foam portions have a density greater than the central foam portion.

23. The mattress of claim 16, wherein the plurality of foam modules include a foot foam section located adjacent to a foot end of the mattress, a head foam section located adjacent to the head end of the mattress, and a seat foam section located between the foot and head foam sections.

24. The mattress of claim 23, wherein the central foam portion of the foam foot section includes a foot base portion, a heel section located on the foot base portion and a calf section located above the foot base portion adjacent to the heel section, the calf section having a density greater than the heel section.

25. The mattress of claim 16, wherein at least one of the plurality of foam modules includes a central foam portion having a top surface formed to include a plurality of transversely extending notches.

26. The mattress of claim 16, wherein a first foam module of the plurality of foam modules is formed to include an angled edge surface, and a second foam module of the plurality of foam modules is also formed to include an angled edge surface configured to engage the angled edge surface formed on the first foam module.

27. A mattress having a head end and a spaced apart foot end defining a length dimension and spaced apart first and second sides defining a width dimension, the mattress comprising:

a cover defining an interior region;

a first foam section located in the interior region of the cover and having a width dimension substantially equal to the width dimension of the mattress, the first foam section being formed to include a first angled edge surface;

a second foam section located in the interior region of the cover adjacent the first foam section and having a width dimension substantially equal to the width dimension of the mattress, the second foam section being formed to include a second angled edge surface configured to engage the first angled edge surface formed on the first foam section; and a foam base located in the interior region of the cover below the first and second foam sections.

28. The mattress of claim 27, further comprising a plurality of fasteners configured to couple the first and second foam sections to the base.

29. The mattress of claim 27, wherein the first foam section is located adjacent the foot end of the mattress, the second foam section is located adjacent the first foam section, and further comprising a third foam section located in the interior region of the cover adjacent the head end of the mattress, the third foam section having a width dimension substantially equal to the width dimension of the mattress.

30. A mattress having a head end and a spaced apart foot end defining a length dimension and spaced apart first and second sides defining a width dimension, the mattress comprising:

a cover defining an interior region;

a first foam section located in the interior region of the cover and having a width dimension substantially equal to the width dimension of the mattress, the first foam section being formed to include a first angled edge surface;

a second foam section located in the interior region of the cover adjacent the first foam section and having a width dimension substantially equal to the width dimension of the mattress, the second foam section being formed to include a second angled edge surface configured to engage the first angled edge surface formed on the first foam section; and a shear cover configured to be located over the first and second foam sections, the shear cover having a low coefficient of friction so that the cover is permitted slide relative to the first and second foam sections.

31. A mattress having a head end and a spaced apart foot end defining a length dimension and spaced apart first and second sides defining a width dimension, the mattress comprising:

a cover defining an interior region, the cover including a bottom surface formed to include at least one pocket, and a magnet located in each of the at least one pockets;

a first foam section located in the interior region of the cover and having a width dimension substantially equal to the width dimension of the mattress, the first foam section being formed to include a first angled edge surface; and a second foam section located in the interior region of the cover adjacent the first foam section and having a width dimension substantially equal to the width dimension of the mattress, the second foam section being formed to include a second angled edge surface configured to engage the first angled edge surface formed on the first foam section.

32. A mattress having a head end and a spaced apart foot end defining a length dimension and spaced apart first and second sides defining a width dimension, the mattress comprising:

a cover defining an interior region;

a first foam section located in the interior region of the cover adjacent the foot end of the mattress and having a width dimension substantially equal to the width dimension of the mattress, the first foam section being formed to include a first angled edge surface;

a second foam section located in the interior region of the cover adjacent the first foam section and having a width dimension substantially equal to the width dimension of the mattress, the second foam section being formed to include a second angled edge surface configured to engage the first angled edge surface formed on the first foam section; and a third foam section located in the interior region of the cover adjacent the head end of the mattress, the third foam section having a width dimension substantially equal to the width dimension of the mattress, and the third foam section including a central foam portion having a top surface formed to include a plurality of transversely extending notches and first and second side foam portions located on opposite sides of the central foam portion.

33. The mattress of claim 32, wherein the center foam portion has an ILD of about 17 to about 21 and the first and second side foam portions have an ILD of about 35 to about 40.

34. The mattress of claim 32, wherein the central foam portion has a foot end formed to include a third angled edge surface configured to engage a fourth angled edge surface formed adjacent a head end of a second foam section.

35. A mattress having a head end and a spaced apart foot end defining a length dimension and spaced apart first and second sides defining a width dimension, the mattress comprising:

a cover defining an interior region;

a first foam section located in the interior region of the cover and having a width dimension substantially equal to the width dimension of the mattress, the first foam section being formed to include a first angled edge surface, the first foam section including side foam portions extending along opposite sides of the foot foam section and a central foam portion located between the side foam portions, the side foam portions having a density greater than the central foam portion; and a second foam section located in the interior region of the cover adjacent the first foam section and having a width dimension substantially equal to the width dimension of the mattress, the second foam section being formed to include a second angled edge surface configured to engage the first angled edge surface formed on the first foam section.

36. The mattress of claim 35, wherein the central foam portion includes a foot base portion, a heel section located on the foot base portion and a calf section located above the foot base portion adjacent to the heel section, the calf section having a density greater than the heel section.

37. The mattress of claim 36, wherein the heel section has an ILD of about 7 to about 10 and the calf section has an ILD of about 17 to about 21.

38. The mattress of claim 36, wherein the calf section includes a the first angled edge surface configured to abut the second angled surface formed on the second foam section.

39. A mattress having a head end and a spaced apart foot end defining a length dimension and spaced apart first and second sides defining a width dimension, the mattress comprising:

a cover defining an interior region;

a first foam section located in the interior region of the cover and having a width dimension substantially equal to the width dimension of the mattress, the first foam section being formed to include a first angled edge surface; and a second foam section located in the interior region of the cover adjacent the first foam section and having a width dimension substantially equal to the width dimension of the mattress, the second foam section being formed to include a second angled edge surface configured to engage the first angled edge surface formed on the first foam section, the second foam section including a central foam portion having a top surface formed to include a plurality of transversely extending notches and first and second side foam portions located on opposite sides of the central foam portion.

40. The mattress of claim 39, wherein the central foam portion has an ILD of about 23 to about 27 and the side foam portions have an ILD of about 35 to about 40.

41. A mattress having a head end and a spaced apart foot end defining a length dimension and spaced apart first and second sides defining a width dimension, the mattress comprising:

a cover defining an interior region;

a first foam section located in the interior region of the cover and having a width dimension substantially equal to the width dimension of the mattress, the first foam section being formed to include a first angled edge surface; and a second foam section located in the interior region of the cover adjacent the first foam section and having a width dimension substantially equal to the width dimension of the mattress, the second foam section being formed to include a second angled edge surface configured to engage the first angled edge surface formed on the first foam section, the first and second foam sections being separately removable from the interior region and each have a central foam portion and first and second side foam portions coupled to and extending along opposite sides of the central foam portion, and each of the first and second foam sections having a length dimension less than the length dimension of the mattress, the first and second side foam portions each having a firmness greater than a firmness of the central foam portion so that the first and second side foam portions cooperate to define first and second borders extending along the first and second sides of the mattress, respectively, between the head end and the foot end of the mattress.

42. A mattress cover comprising:

a top cover portion formed from a liquid impervious material, the top cover portion having a top surface, and a bottom edge, and four corners, each of the four corners including a generally horizontal seam located at a location spaced apart from the top surface, and a generally vertical seam extending downwardly from the horizontal seam to the bottom edge so that the generally vertical seam and the generally horizontal seam meet to form a substantially T-shaped seam.

43. The mattress cover of claim 42, wherein seams are formed by RF welding.

* * * * *